US006170549B1

(12) United States Patent
Marschke

(10) Patent No.: US 6,170,549 B1
(45) Date of Patent: Jan. 9, 2001

(54) SINGLE FACER WITH RESILIENT SMALL DIAMETER CORRUGATING ROLL

(75) Inventor: Carl R. Marschke, Phillips, WI (US)

(73) Assignee: Marquip, Inc., Phillips, WI (US)

( * ) Notice: Under 35 U.S.C. 154(b), the term of this patent shall be extended for 0 days.

(21) Appl. No.: 09/336,104

(22) Filed: Jun. 18, 1999

(51) Int. Cl.[7] ..... B31F 1/26; B31F 1/28

(52) U.S. Cl. ..... 156/472; 156/471; 156/205; 156/210; 493/463; 264/295; 425/369

(58) Field of Search ..... 156/205, 210, 156/471, 472, 473, 474; 493/463; 264/295; 425/369

(56) References Cited

U.S. PATENT DOCUMENTS

| | | | | |
|---|---|---|---|---|
| 3,053,309 | | 9/1962 | Wilson et al. | 156/471 |
| 3,477,906 | * | 11/1969 | Rabstad . | |
| 5,419,796 | | 5/1995 | Miller | 156/207 |
| 5,611,887 | | 3/1997 | Takenaka et al. | 156/472 |
| 5,626,709 | | 5/1997 | Keeny | 156/472 |
| 5,628,865 | | 5/1997 | Marschke | 156/473 |
| 5,681,422 | | 10/1997 | Marschke | 156/472 |

* cited by examiner

*Primary Examiner*—Sam Chuan Yao
(74) *Attorney, Agent, or Firm*—Andrus, Sceales, Starke & Sawall

(57) ABSTRACT

A single facer for corrugated paperboard of the type using a very large diameter fluted bonding roll and a much smaller diameter fluted corrugating roll which engages the bonding roll to provide a corrugating nip. The small diameter corrugating roll is made to be resilient so that it is capable of inward deflection in the vicinity of the corrugating nip in order to cushion impact as the rolls interengage along the corrugating nip. This cushioning deflection absorbs vibrational movement due to chordal action of the interengaging flutes, and thereby reduces noise levels, roll wear and improves the quality and consistency of corrugation.

10 Claims, 5 Drawing Sheets

20
21
18
21
21
21
21
17
16
13
11
10
15
28
22
13
14
12
25
24
23
26

SINGLE FACER WITH RESILIENT SMALL DIAMETER CORRUGATING ROLL

FIELD OF THE INVENTION

The invention pertains to an apparatus for forming a single face web of corrugated paperboard. More particularly, the invention relates to a corrugating roll assembly comprising a large diameter corrugating roll (i.e. a bonding roll) and a small diameter corrugating roll in which the small diameter roll is resilient so that it is capable of deflection in the vicinity of the corrugating nip in order to cushion impact as the rolls mesh along the corrugating nip.

BACKGROUND OF THE INVENTION

In the manufacture of corrugated paperboard, a single facer apparatus is used to corrugate the medium web, to apply glue to the flute tips on one face of the corrugated medium web, and to bring a liner web into contact with the glued flute tips of the medium web with the application of sufficient heat and pressure to provide an initial bond. For many years, conventional single facers have typically included a pair of fluted corrugating rolls and a pressure roll, which are aligned so that the axes of all three rolls are generally coplanar. The medium web is fed into a corrugating nip formed by the interengaging corrugating rolls. While the corrugated medium web is still on one of the corrugating rolls, adhesive is applied to the flute tips by a glue roll. The liner web is immediately thereafter brought into contact with the adhesive-coated flute tips.

In the past, the fluted corrugating rolls have typically been generally the same size as each other. More recently, a significantly improved single facer apparatus has been developed in which the corrugating rolls comprise a large diameter bonding roll and a substantially smaller diameter roll, with the ratio of diameters preferably being 3:1 or greater. One such apparatus is disclosed in U.S. Pat. No. 5,628,865, and improvements thereon are described in copending application Ser. Nos. 08/854,953, filed May 13, 1997 and 09/044,516, filed Mar. 19, 1998, and 09/244,904, filed Feb. 4, 1999, all of which disclosures are incorporated herein by reference. In accordance with these disclosures, the single facer typically includes a backing arrangement for the small diameter corrugating roll. One preferred backing arrangement includes a series of axially adjacent pairs of backing idler rollers, each pair having a backing pressure belt entrained therearound. Each of the pressure belts is positioned to bear directly against the fluted surface of the small diameter corrugating roll on the side of the small corrugating roll opposite the corrugating nip. Each pair of associated idler rolls and pressure belts is mounted on a linear actuator, and can thus engage the small diameter corrugating roll with a selectively adjustable force. The application of force against the small diameter corrugating roll, in turn, applies force along the corrugating nip between the small diameter roll and the large diameter roll. Typically, a force of approximately 100 lbs. per linear inch (e.g. 10,000 lbs. for a 100 inch roll) is desirable for properly fluting a medium web at typical line speeds.

The impact of the flutes on the small diameter corrugating roll against the flutes on the large diameter corrugating roll along the corrugating nip can cause undesirable vibrations that can detriment the quality of corrugation. More specifically, chordal action due to the interengagement of the rolls causes the small diameter roll to move up and down. The center axis of the large diameter roll is analytically stationary, and vibrational energy is transmitted primarily to the small diameter roll and to the belted backing arrangement. It has been found that excessive vibrations of the belted backing arrangements is sometimes evident under certain high-speed operating conditions, especially when the system is operated at or near the natural resonance frequency of the system.

SUMMARY OF THE INVENTION

The invention involves the use of a small diameter corrugating roll that is designed to cushion contact at the corrugating nip between the flutes on the small diameter corrugating roll and the flutes on the large diameter corrugating and bonding roll. The cushioning by the small diameter corrugating roll reduces the transmission of vibration impulses to the belted backing arrangement, and thus reduces undesired vibrational movement of the small diameter corrugating roll. Reduction of such vibrational movement, and primarily reduction of radial vibrational movement, improves the quality and consistency of the corrugation. It also reduces noise levels and roll wear rate.

In its preferred form, the small diameter corrugating roll is made to be resilient, e.g., constructed using an inner steel tube or carbon fiber tube having approximately a four inch outside diameter and a 1/8 inch wall thickness. Preferably, the small diameter corrugating roll is a composite roll in which the flutes are made of a sacrificial material such as reinforced phenolic resin as described in the above-incorporated copending U.S. patent application Ser. No. 09/244,904. Such flutes are preferably mounted on the outside surface of the resilient steel or carbon fiber tube with epoxy.

In operation, the resilient tube deflects inward as the flutes on the small diameter roll impact the flutes on the large diameter roll at the corrugating nip. This deflection occurs without causing substantial movement of the center axis of the tube for the small diameter roll. Preferably, the maximum inward deflection of the resilient tube is within the range of 2/1000 to 5/1000 of an inch for typical corrugating loading conditions. While this amount of deflection may seem relatively small, it significantly reduces the amplitude of vibrations transmitted to the belted backing arrangement. After the deflected region passes through the corrugating nip, it springs outward to its normal position. If the flutes are made of a sacrificial phenolic resin or other similar material, the flutes themselves assist in cushioning the impact, although deflection of the resilient tube accounts for a substantial portion of the cushioning.

It is preferred that the flutes on the small diameter corrugating roll have a different profile than the flutes on the large diameter corrugating roll such that there is a clearance between flute tips on the large diameter bonding roll and the gullets or roots of the flutes on the small diameter corrugating roll. In this manner, the medium web fed to the corrugating nip is pressured against the fluted profile of the large diameter corrugating roll as the medium web passes through the meshed flutes in the corrugating nip. Also, inasmuch as wear does not effect the radial distance of the gullets, this arrangement assures that the small diameter corrugating roll follows the bonding roll more consistently.

Another advantage of designing the small diameter corrugating roll with a relatively thin wall thickness is that the reduced weight of the small diameter roll has been found to significantly change the natural resonance frequency for the system. In fact, using a small diameter roll having a thin wall in accordance with the invention typically causes the natural resonance frequency to shift upward outside of practical operating speeds for producing corrugated paperboard.

DETAILED DESCRIPTION OF THE INVENTION

Figure 1:
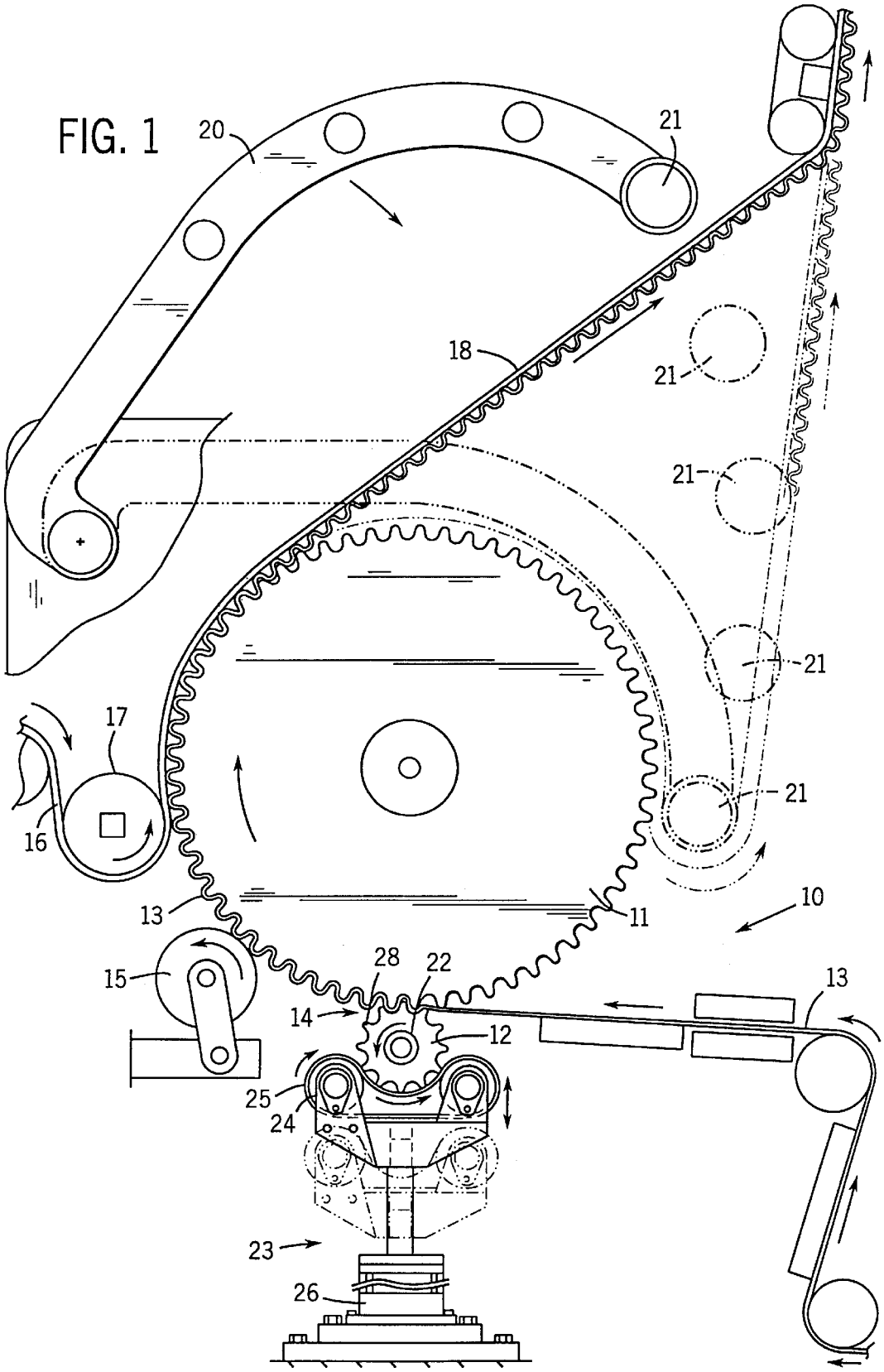
FIG. 1 is a side elevation view of a single facer using a small diameter corrugating roll designed in accordance with the present invention.

Referring to FIG. 1, a single facer 10 includes a very large diameter upper corrugating roll 11 (i.e. a bonding roll 11) and a much small diameter lower corrugating roll 12. The rolls 11, 12 are fluted and mounted for interengaging rotational movement on parallel axes, all in a manner well known in the art and which has been described in greater detail in the above-identified copending patent applications. A medium web 13, which may be suitably pretreated by moistening and heating, is fed into a corrugating nip 14 formed by the interengaging corrugating rolls 11 and 12. The corrugating medium web 13, as it leaves the nip 14, remains on the surface of the large diameter bonding roll 11. At that point in the process, a glue roll 15 applies a liquid adhesive, typically starch, to the exposed flute tips of the corrugated medium web 13. Immediately thereafter, a liner web 16 is brought into contact with the glued flute tips of the corrugated medium web by a liner delivery roll 17. The resulting freshly glued single face web 18 continues around at least a portion of the outer circumference of the large diameter roll 11. Inasmuch as the large diameter roll 11 also functions as a bonding roll, it is internally heated, for example with steam, to cause the starch adhesive to enter the so-called "green bond" stage. By assuring that green bond is reached while the single face web 18 is still on the bonding roll 11, integrity of the glue lines is better assured and downstream handling, including back-wrapping, is not likely to disturb the bond. The circumferential residence of the single face web 18 on the bonding roll 11 may be varied by the use of a pivotable wrap arm 20 depending on many variable factors, such as paper weight, web speed, bonding roll temperature, and the like. The free end of wrap arm 20 includes an idler roller 21 that bears on the outer face of the liner web 16 to control the amount of wrap of the single face web 18 on the bonding roll 11.

The large diameter corrugating and bonding roll 11 typically has a diameter in the range of 39 inches (about 1000 millimeters) and the much smaller diameter lower corrugating roll 12 typically has a diameter of about five inches (about 128 millimeters). The prior art identified herein above provides various backing arrangements for the small diameter roll 12, one of which backing arrangements 23 is shown in the drawing. The backing arrangement 23 includes a series of axially adjacent pairs of backing idler rolls 24, each of which pairs has a backing belt 25 entrained therearound. Each of the pressure belts 25 is positioned to bear directly against the fluted surface of the small diameter corrugating roll 12. Each associated pair of idler rolls 24 and backing belt 25 is mounted on a linear actuator 26. By operation of the linear actuator 26, the pressure belts 25 are moved to engage the small diameter roll 12 with a selectively adjustable force. The entire backing arrangement 23 is described in more detail in copending application Ser. No. 09/044,516, identified above.

As indicated in the background discussion above, the large diameter roll 11 has substantially more mass than the small diameter corrugating roll 12, and therefore remains relatively stable as it rotates even at high speeds. On the other hand, due to chordal action at the nip 14, substantial up and down movement can occur in the small diameter corrugating roll 12 and the backing arrangement 23. Under extreme conditions, such vibrations (especially in the radial direction) can cause the small diameter corrugating roll 12 to bounce at the corrugating nip 14, and in any case cause increased noise levels and increased wear rates. The vibration problem is exacerbated if the line speed matches the natural frequency of the system. For example, in early designs of systems having a small corrugating roll, the small diameter corrugating roll was typically made of solid steel. Due to the weight of solid small diameter corrugating rolls 12, the natural resonance frequency of such systems occurred at a line speed of approximately 300 feet per minute, which is within the typical operating range of single facers 10.

Figure 2:
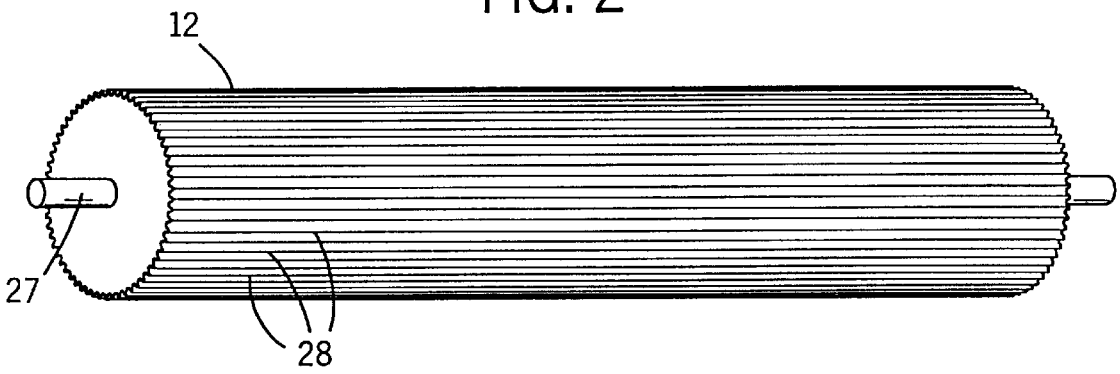
FIG. 2 is a perspective view of a small diameter corrugating roll constructed for use in accordance with the invention.

In accordance with copending patent application Ser. No. 09/244,904, it has been found to be advantageous to construct the flutes on the small diameter corrugating roll 12 from a fiber reinforced phenolic resin mounted upon an inner cylindrical tube. Such a composite roll 12 is shown in FIG. 2. The composite roll 12 in FIG. 2 is illustrative of the prior art roll shown in the above referenced copending patent application, and is also illustrative of a small diameter corrugating roll 12 constructed in accordance with a preferred embodiment of the invention. Referring to FIG. 2, the small diameter corrugating roll 12 is machined with a conventional hobbing machine to cut the flutes 28 therein. Stub ends with shafts 27 are mounted to the roll 12.

Figure 3:
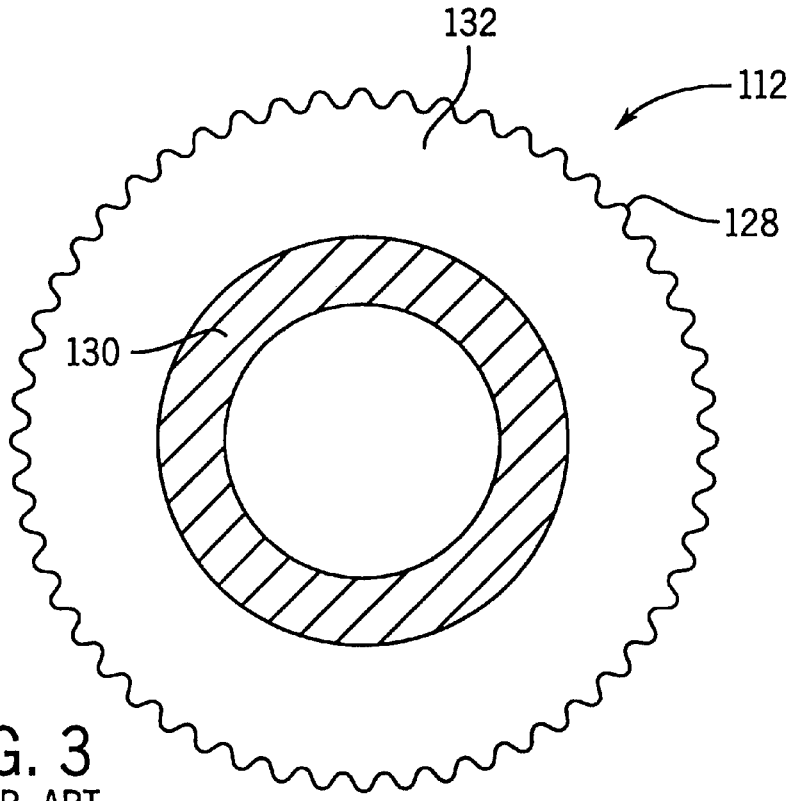
FIG. 3 PRIOR ART
FIG. 3 is a cross-sectional view of a small diameter corrugating roll in accordance with the prior art.

FIG. 3 is a cross-section illustrating the composite construction of the prior art small diameter roll 112. The prior art roll 112 has a relatively rigid, solid steel tube 130 and a phenolic resin-impregnated sacrificial layer 132 adhered to the tubular shaft 130. The outer diameter of roll 112 shown in FIG. 3 is typically about five inches as measured from diametrically opposed flute tips. The outside diameter of the steel shaft 130 is typically about 3⅛ inches and the thickness of the wall of the steel tube 130 is typically be about ½ of an inch. It is preferred that the sacrificial fluted layer 132 include a cotton canvas as a reinforcing fabric for the phenolic resin, although other reinforcing fibers are also believed to be suitable. In addition, it may be possible to use other resins for the sacrificial layer 132. As mentioned, the sacrificial layer 132 is preferably attached using epoxy. The construction of the prior art roll 112 shown in FIG. 3 is explained in detail in copending patent application Ser. No. 09/244,904, as well as various advantages of using the sacrificial layer 132.

The use of a sacrificial phenolic fluted layer 132 in itself results in quieter operation, as well as longer wear life for the large diameter bonding roll 11. The extended wear lift for the bonding roll 11 is particularly desirable because the large diameter bonding roll 11 is much more expensive than the small corrugating roll 12. When the small diameter phenolic roll 112 wears to a point where it can no longer be effective, the roll 112 may be discarded, or preferably, it may be rehobbed to reform the flute pattern and used again.

Figure 4:
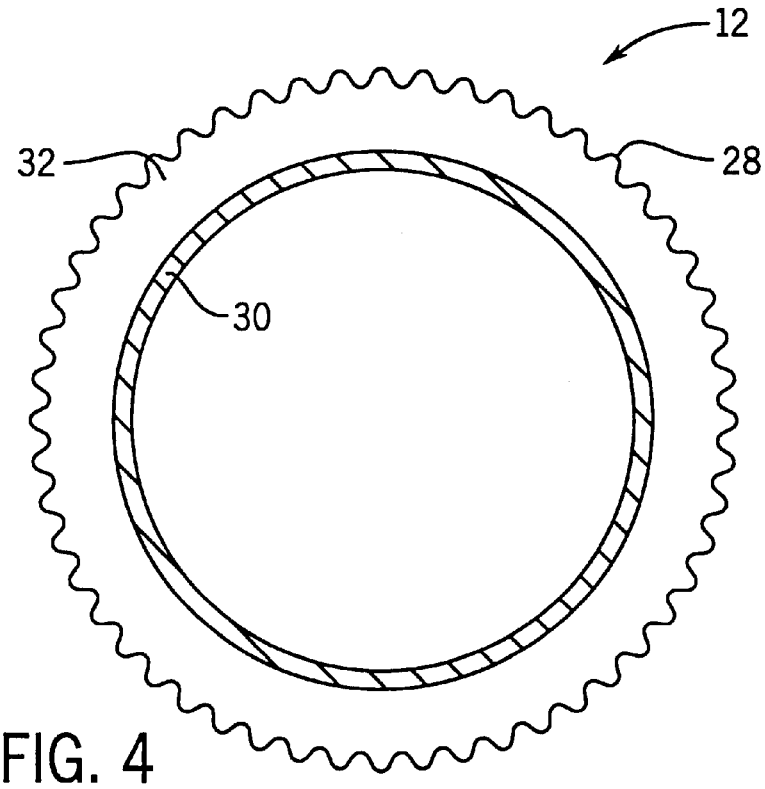
FIG. 4 is a cross-sectional view of a small diameter corrugating roll in accordance with a preferred embodiment of the invention.

FIG. 4 shows a small diameter corrugating roll 12 constructed in accordance with the preferred embodiment of the invention. More specifically, the roll 12 includes a thin wall steel tube 30 or a thin wall carbon fiber tube 30. Preferably, the outside diameter of the steel or carbon fiber tube 30 is about four inches, and the inside diameter of the steel tube 30 is about 3.75 inches. Therefore, the steel or carbon fiber tube 30 has a wall thickness of about ⅛ of an inch, thus rendering the tube 30 somewhat flexible and resilient. The fluted sacrificial layer 32 (preferably reinforced phenolic resin as described above) is mounted to the outside surface of the steel or carbon fiber tube 30 in order to form a composite structure for the small diameter corrugating roll 12.

For the relatively rigid small diameter corrugating roll 112 shown in prior art FIG. 3, the roll 112 moves up and down due to interaction between the flutes of the large diameter roll 11 and the flutes of the small diameter roll 112. As mentioned, this motion is well known in the industry and is called "chordal action". Analysis has shown that the amplitude of vertical motion of a rigid, small diameter corrugating roll 112 as shown in FIG. 3 is typically within the range of 2/1000 of an inch to 3/1000 of an inch at normal operating loads and speeds. At high line speeds, vertical motion creates a dynamic force that is transmitted both to the bonding roll 11 and to the supporting belt 25. As a result, noise level and roll surface wear are relatively high, even when using a sacrificial layer 132 construction. In addition, bouncing can actually occur, especially at speeds at or near the natural resonance frequency.

Figure 4A:
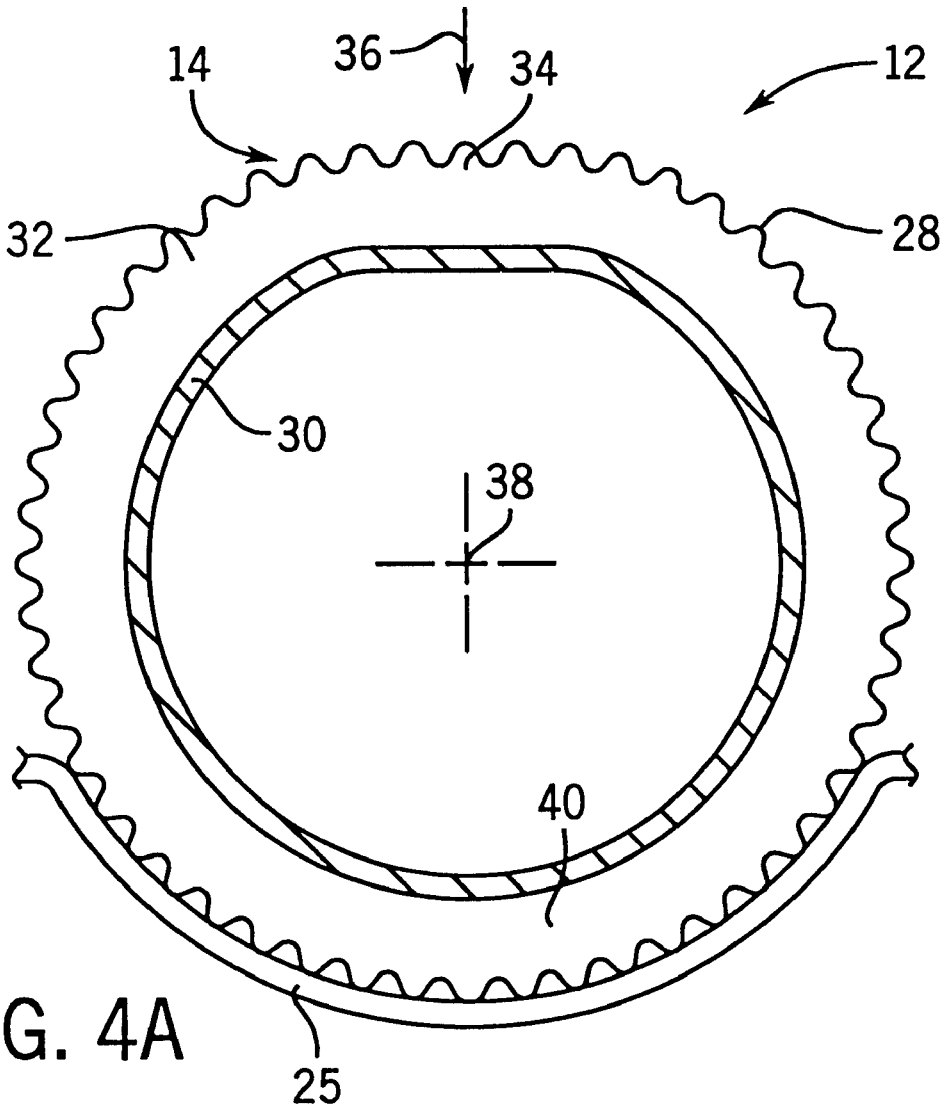
FIG. 4*a* is a view similar to FIG. 4 illustrating cushioning deflection (exaggerated) of a small diameter corrugating roll in accordance with the invention.

In contrast, a small diameter corrugating roll 12 constructed in accordance with the invention absorbs vertical vibration due to chordal action by providing for cushioning deflection within the inner tube 30. FIG. 4*a* illustrates this cushioning deflection in an exaggerated manner. In FIG. 4*a*, the portion 34 of the small diameter corrugating roll 12 engaging with the flutes on the large diameter roll 11 (not shown in FIG. 4*a*) are deflected inward in the direction of arrow 36 in order to cushion impact at the corrugating nip 14. Finite element analysis has shown that the maximum amount of deflection (arrow 36) is in the range of 2/1000 of an inch to 5/1000 of an inch in the vicinity of the corrugating nip 14 when the roll 12 is subject to a backing force of 100 lbs. per inch. For a composite phenolic/carbon fiber roll 12 having the previously disclosed dimensions and loading, the typical deflection is approximately 3/1000 of an inch. For a steel tube 30, the deflection is slightly less. Although the portion 34 of the small diameter corrugating roll 12 deflects inward, the center axis 38 of the roll 12 remains relatively stable. Also, the portion 40 of the roll 12 in contact with the backing belt 25 remains round because the deflected portion 34 returns to its normal position after it passes the corrugating nip 14. It has been found that using a lower corrugating roll 12 as constructed in accordance with the invention to have a resilient and relatively flexible inner tube 30 further reduces noise level and roll wear. In addition, a small diameter corrugated roll 12 constructed in accordance with the preferred embodiment of the invention has less mass than conventional solid steel rolls, as well as the prior art composite roll 112 shown in FIG. 3. Because of the lighter mass, the resonance frequency of the system occurs at a higher line speed that is well above normal operating speeds for single facers.

Figure 5:
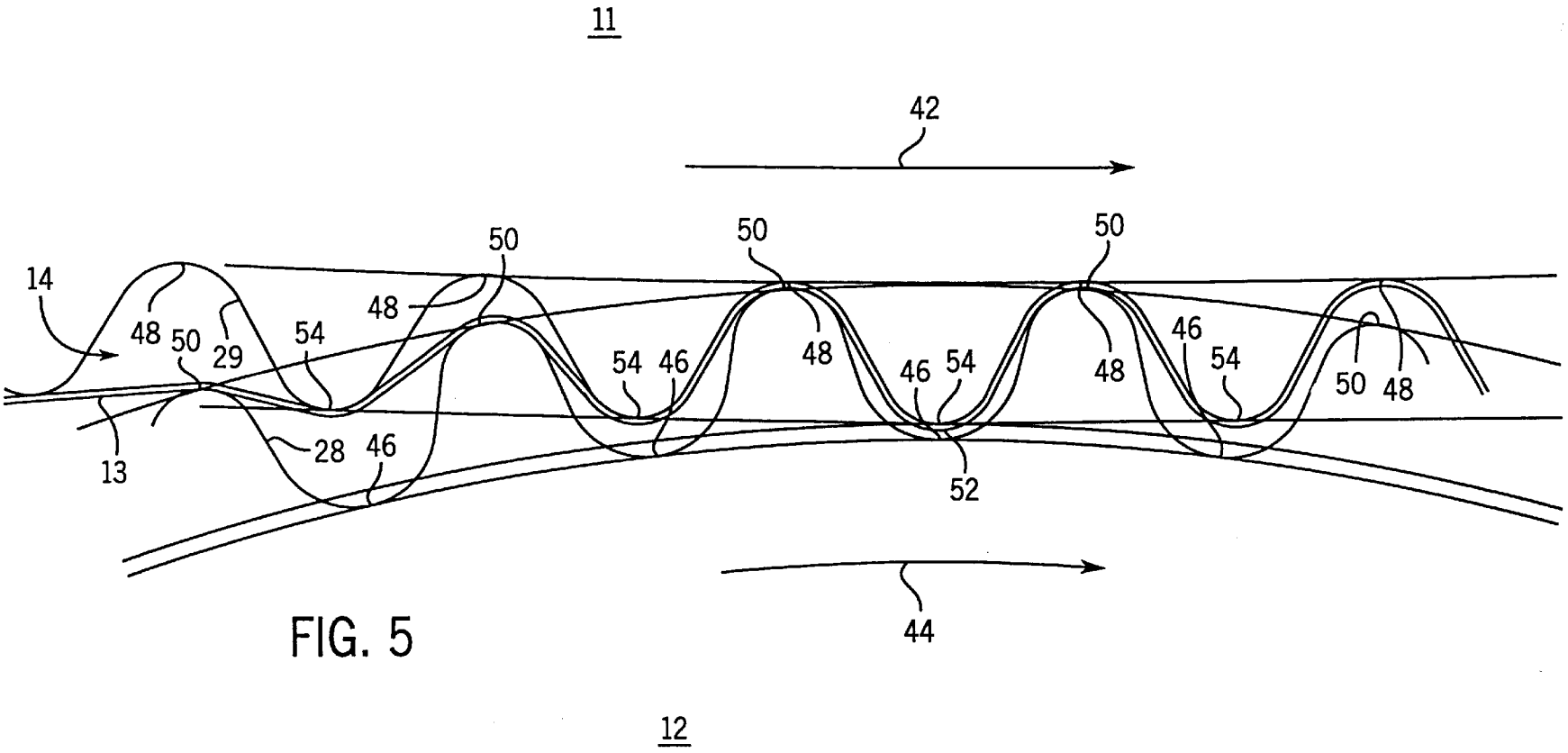
FIG. 5 is a detailed schematic view showing the meshing of flutes on a large diameter corrugating roll with flutes on a small diameter corrugating roll with a medium web therebetween as in accordance with the invention.

FIG. 5 is a detailed view illustrating the medium web 13 entering the corrugating nip 14 between flutes 28 on the small diameter corrugating roll 12 and the flutes 29 on the large diameter roll 11 (i.e. the bonding roll 11). In FIG. 5, the bonding roll 11 is rotating in the direction of arrow 42 and the small diameter corrugating roll is rotating in the same direction as depicted by arrow 44. The medium web 13 enters the corrugating nip from the left side of FIG. 5. The profile of the flutes 28 on the small diameter corrugating roll 12 are different than the profiles of the flutes 29 on the large diameter corrugating roll 11. More specifically, the gullets or roots 46 of the flutes 28 on the small diameter corrugating roll 12 are deeper than the flute gullets 48 for the large diameter bonding roll 11. With this configuration, only the tips 50 of the flutes 28 on the small diameter corrugating roll 12 contact the flute gullets 48 on the bonding roll 11. This means that there is a clearance 52 between flute tips 54 on the bonding roll 11 and the flute gullets 46 on the small diameter corrugating roll 12 (e.g., preferably 10/1000 to 20/1000 of an inch). Also, inasmuch as the radial distance from the flute gullets 48 on the bonding roll 11 to the center axis for the bonding roll 11 is constant and the only point of contact between the bonding roll 11 and the corrugating roll 12 is at the flute gullets 48 for the bonding roll 11, the speed of the small diameter corrugating roll 12 will more consistently follow the bonding roll 11.

Various alternatives and other embodiments are contemplated as being within the scope of the following claims which particularly point out and distinctly claim the subject matter regarded as the invention. For example, it is not necessary for the small diameter corrugating roll 12 to have a composite construction to implement the primary features of the invention.

We claim:

1. A single facer apparatus for forming a single face corrugated web comprising:

a large diameter fluted corrugating roll and a small diameter fluted corrugating roll positioned with parallel roll axes such that flutes on the small diameter corrugating roll are loaded against and mesh with flutes on the large diameter corrugating roll to form a corrugating nip therebetween; and a backing arrangement in engagement with the small diameter corrugating roll to apply pressure on the small diameter corrugating roll and in turn apply pressure along the corrugating nip; and wherein the small diameter corrugating roll comprises a resilient tubular member that deflects locally in the vicinity of the corrugating nip as flutes on the small diameter corrugating roll impact flutes on the large diameter corrugating roll, thereby cushioning impact throughout the corrugating nip and further wherein the resilient tubular member is a steel or carbon fiber inner layer having a predetermined thickness such that a portion of the inner layer is deflected inwardly as the small corrugating roll engages against the large corrugating roll.

2. An apparatus as recited claim 1 wherein the inner layer is made of steel having a thickness of approximately ⅛ of an inch.

3. An apparatus as recited in claim 2 wherein the outer diameter of the small diameter corrugating roll as measured from diametrically opposed flute tips is approximately five inches and an inside diameter of the resilient tubular member of the small diameter corrugating roll is approximately four inches.

4. An apparatus as recited in claim 1 wherein the inner layer is made of carbon fiber.

5. An apparatus as recited in claim 1 wherein the small diameter corrugating roll further comprises a fluted sacrificial layer that is made of a materiel having a significantly lower hardness than a material forming a fluted surface of the large diameter corrugating roll such that wear imposed by engagement of the rolls is borne substantially by the small diameter corrugating roll.

6. An apparatus as recited in claim 5 wherein the fluted sacrificial layer is made from a fiber reinforced phenolic resin glued to the resilient tubular member.

7. An apparatus as recited in claim 1 wherein flutes on the large diameter corrugating roll have a different profile than flutes on the small diameter corrugating roll such that there is clearance between a tip of a flute on the large diameter corrugating roll and a gullet of an engaged flute on the small diameter corrugating roll as the flutes pass through the entire corrugating nip.

8. An apparatus as recited in claim 7 wherein the recited clearance is between $^{10}/_{1000}$ and $^{20}/_{1000}$ of an inch.

9. An apparatus as recited in claim 1 wherein maximum deflection of the resilient tubular member as flutes on the small diameter corrugating roll impact flutes on the large diameter corrugating roll in the corrugating nip is within the range of $^{2}/_{1000}$ of an inch to $^{5}/_{1000}$ of an inch.

10. An apparatus as recited in claim 1 further comprising:

a glue roll that applies starch adhesive to expose flute tips of a corrugated medium being transported along the large diameter corrugating roll downstream of the corrugating nip; and a liner delivery roll that provides a liner web into contact with the glued flute tips of the corrugated medium being transported along the large diameter corrugating roll at a location downstream of the glue roll.

* * * * *